US012690630B2

(12) United States Patent
Walters-Young

(10) Patent No.: US 12,690,630 B2
(45) Date of Patent: Jul. 28, 2026

(54) BRA WITH ABSORBENT INSERTS BENEATH EACH BREAST

(71) Applicant: Bianca L. Walters-Young, Chino, CA (US)

(72) Inventor: Bianca L. Walters-Young, Chino, CA (US)

( * ) Notice: Subject to any disclaimer, the term of this patent is extended or adjusted under 35 U.S.C. 154(b) by 0 days.

(21) Appl. No.: 19/276,477

(22) Filed: Jul. 22, 2025

(65) Prior Publication Data

US 2025/0344782 A1 Nov. 13, 2025

Related U.S. Application Data

(63) Continuation-in-part of application No. 18/668,919, filed on May 20, 2024, now abandoned.

(60) Provisional application No. 63/519,390, filed on Aug. 14, 2023.

(51) Int. Cl.
*A41C 3/12* (2006.01)

(52) U.S. Cl.
CPC ..... *A41C 3/12* (2013.01)

(58) Field of Classification Search
CPC ..... A41C 3/12
USPC ..... 450/57, 37
See application file for complete search history.

(56) References Cited

U.S. PATENT DOCUMENTS 1,026,326 A 5/1912 Leporin
5,603,653 A * 2/1997 Hartman ..... A41B 9/12 450/56
5,716,255 A 2/1998 Abercrombie et al.
5,998,693 A 12/1999 Zagame
6,203,399 B1 3/2001 Hackney
6,264,530 B1 7/2001 Cosentino
6,341,377 B1 1/2002 Faries, Jr. et al.
6,406,353 B1 6/2002 Harper
7,905,763 B1 3/2011 Frank
8,075,367 B2 12/2011 Taylor
8,277,276 B2 * 10/2012 Waitz ..... A41C 3/10 450/39
9,629,753 B2 4/2017 Golubovic et al.
9,770,056 B2 9/2017 Sung
9,961,946 B2 5/2018 Calhoun
10,136,682 B1 11/2018 Marcella
10,376,419 B2 8/2019 Lilien
10,638,799 B2 5/2020 Karon et al.
10,653,563 B2 5/2020 Lilien
(Continued)

*Primary Examiner* — Gloria M Hale
(74) *Attorney, Agent, or Firm* — Dunlap Bennett & Ludwig PLLC; Anna L. Kinney

(57) ABSTRACT

A bra includes a pair of cups that support the wearer's breasts and a pair of absorbent inserts (12, 112) mounted to the cups. The inserts are arcuate with tapered ends, conforming to the lower curvature of the breasts, and are designed to absorb perspiration while providing a discreet and comfortable fit. The inserts may be composed of an antimicrobial, odor-neutralizing material, such as approximately 70% viscose from bamboo and approximately 30% cotton, and may optionally include a scented composition. The inserts are either removably housed within fabric sleeves (114) or stitched along the lower interior region of the cups, allowing for pivotability and adjustability. The bra may include a wide elastic band (116) for support and comfort. This design provides targeted moisture absorption, odor control, and a subtle lifting effect, making the bra suitable for daily wear or sports applications.

9 Claims, 4 Drawing Sheets

(56) References Cited

U.S. PATENT DOCUMENTS

| | | | | |
|---|---|---|---|---|
| 11,930,864 | B2 | 3/2024 | Costanza | |
| 12,150,496 | B2 * | 11/2024 | Zarabi | A41C 3/0021 |
| 2005/0164602 | A1 | 7/2005 | Armstrong et al. | |
| 2008/0004588 | A1 * | 1/2008 | Gavitt | A61F 13/145<br>604/385.07 |
| 2010/0022164 | A1 * | 1/2010 | Taylor | A41C 3/10<br>604/360 |
| 2010/0024093 | A1 | 2/2010 | Richards | |
| 2014/0329438 | A1 * | 11/2014 | Horii | A41C 3/142<br>450/41 |
| 2017/0000194 | A1 * | 1/2017 | Huyghe | A41C 3/0035 |
| 2018/0084841 | A1 * | 3/2018 | Calhoun | A41C 3/144 |
| 2018/0185198 | A1 | 7/2018 | Clarke | |
| 2023/0091122 | A1 * | 3/2023 | Harrison | A41C 3/12<br>450/57 |
| 2023/0346050 | A1 * | 11/2023 | Mayes | A41C 3/0064 |

* cited by examiner

BRA WITH ABSORBENT INSERTS BENEATH EACH BREAST

CROSS-REFERENCE TO RELATED APPLICATION

This application is a continuation-in-part of U.S. application Ser. No. 18/668,919, filed May 20, 2024, now abandoned, the contents of which are herein incorporated by reference. application Ser. No. 18/668,919 claimed the benefit of priority of U.S. provisional application No. 63/519,390, filed Aug. 14, 2023, the contents of which are herein incorporated by reference.

BACKGROUND OF THE INVENTION

The present invention relates to undergarments and, more particularly, to bras incorporating absorbent inserts beneath each breast.

Most full breasted women suffer from excessive perspiration under their breasts. The perspiration may sometimes seep through their clothing and create embarrassing moments. Other bras have padding that does NOT directly address the problem of excessive perspiration. Currently, on the market, apparatuses exist to capture excessive perspiration. Not only are they bulky and unattractive, (they protrude outside of the bra) and can be seen under a halter top, a thin material blouse, or any item of clothing that is form fitting.

As can be seen, there is a need for a streamlined solution that offers targeted moisture absorption and odor control while maintaining comfort, support, and a discreet appearance.

SUMMARY OF THE INVENTION

In one aspect of the present disclosure, a bra includes a pair of cups configured to support the wearer's breasts and a matching pair of substantially symmetrical arcuate, tapered absorbent pad inserts mounted to the cups. The inserts conform to the lower curvature of each breast and are operative to absorb perspiration beneath the respective breasts by placing each tapered insert directly underneath the breast to absorb the perspiration.

In another aspect of the present disclosure, each absorbent insert comprises an antimicrobial, odor-neutralizing material—such as about 70% viscose from bamboo and about 30% cotton—and may further include a scented composition. A fabric sleeve disposed along a lower interior region of each cup removably accommodates the insert, permitting the insert to pivot or slide within the sleeve. Alternatively, each insert may be stitched along the lower interior region of the cup so that the insert remains pivotable about the stitched edge.

These and other features, aspects and advantages of the present invention will become better understood with reference to the following drawings, description, and claims.

DETAILED DESCRIPTION OF THE INVENTION

Figure 1:
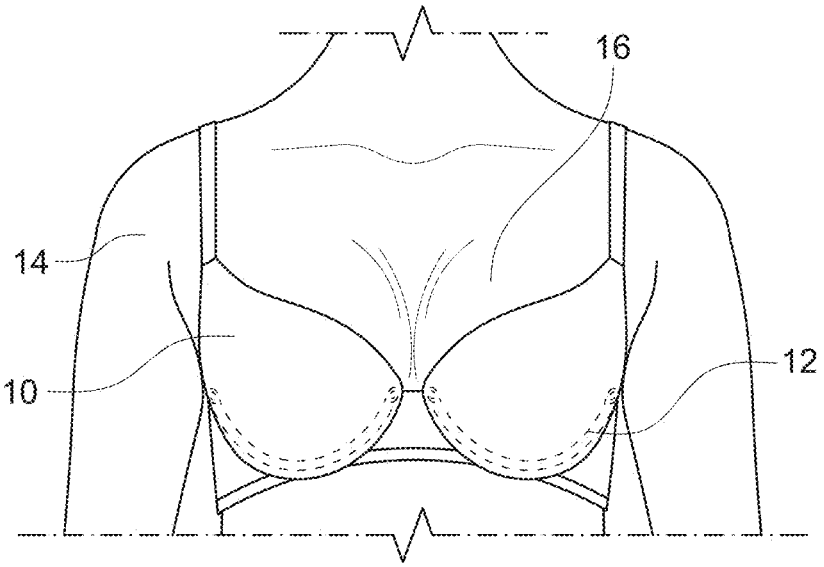
FIG. 1 is a front elevation view of a bra according to an embodiment of the present disclosure, shown in use.
Figure 2:
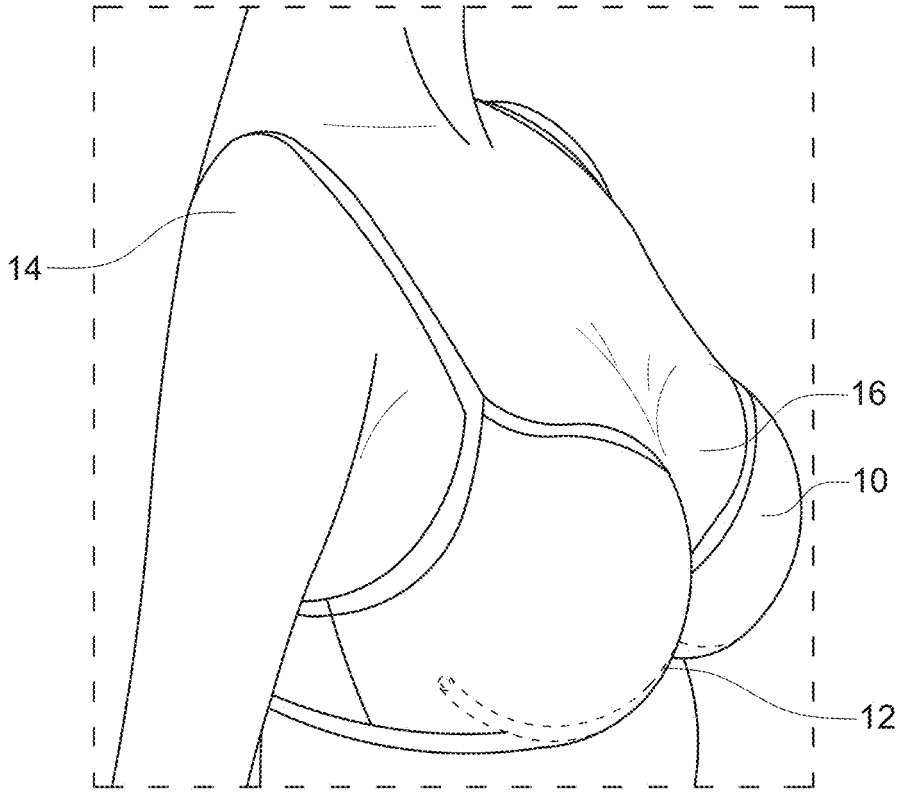
FIG. 2 is a side perspective view thereof, shown in use.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, one embodiment of the present invention is a bra with specialized absorbent inserts positioned beneath each breast. These inserts are designed to capture and wick away moisture while remaining discreet and comfortable.

The inserts may be manufactured from any known absorbent and/or moisture wicking material. For example, the absorbent insert may be composed of bamboo-based antimicrobial material including about 70% viscose from bamboo and about 30% cotton, providing antimicrobial, odor-neutralizing, and moisture-wicking properties.

The absorbent insert is generally arcuate with tapered ends, for example shaped as a banana, crescent-moon, or J-shape, and is configured to fit snugly beneath the breast and allow for adjustability.

In some embodiments, the absorbent inserts may be provided in the form of a soft absorbent material tube affixed onto the bra. Each insert sits directly under the breast, lifting the breast and capturing excessive perspiration, and preventing it from seeping through the clothing, thus allowing the end user to continue their day worry free.

The bra may include an elastic band, for example about three-inches-wide, covered with fabric, designed to prevent rolling and provide sturdy support. The wide band improves comfort and durability.

The bra may be a daily wear bra or a sports bra, each utilizing the same insert for different use cases.

The absorbent insert may be either sewn into the bra or removably installed within a channel or compartment, allowing for user preference and ease of washing. Unlike conventional designs, when the inserts are sewn in, they are not stitched along the entire perimeter, enabling them to pivot for improved comfort and adaptability to different body shapes.

The inserts may include a scented odor eater material or a variety of scented essences to further neutralize odors. This feature provides an additional layer of odor control and allows for user customization.

The insert, when positioned beneath the breast, provides dual-functionality—a lifting effect in addition to moisture absorption, antimicrobial action, and/or odor control.

To use the bra, the wearer may put the bra on and place the inserts directly under their breasts. In some embodiments, the user may lift each breast and position the insert beneath the breast.

Referring to FIGS. 1-8, FIGS. 1-2 show a bra according to an embodiment of the present disclosure, with cups 10 supporting the breasts 16 and an absorbent insert 12 positioned beneath each breast. The insert 12 conforms to the breast's curvature for discreet, adjustable moisture absorption and provides a subtle lifting effect.

Figure 3:
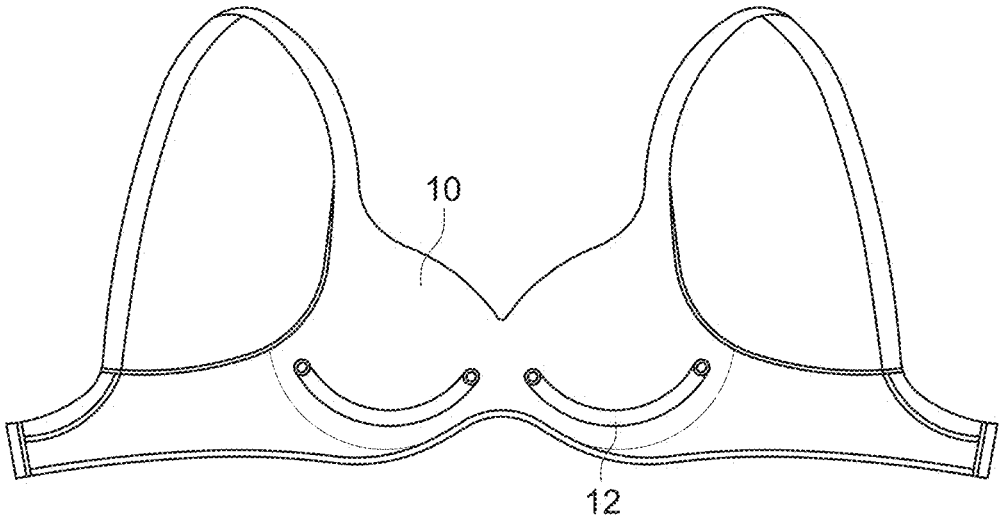
FIG. 3 is a rear elevation view thereof, shown laid flat in an open position.
Figure 4:
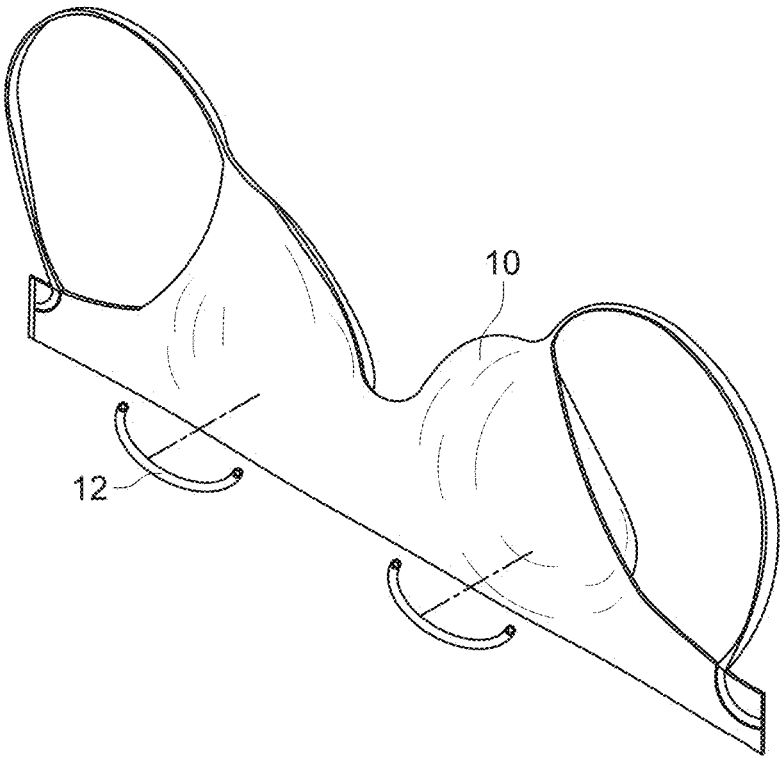
FIG. 4 is a rear perspective exploded view thereof.

The internal arrangement is illustrated in FIGS. 3-4, where the insert 12 is placed along the lower interior of the cup 10, fitting snugly and discreetly to absorb moisture and provide lift. The insert 12 is a separate, adjustable component integrated into the bra in a fixed or removable manner (e.g., for ease of cleaning) that maintains a discreet and seamless appearance. The insert 12 is depicted as being positioned beneath the bra cup 10, conforming to the natural curvature of the lower breast area. This configuration ensures that the insert 12 is positioned in a manner that captures perspiration and provides moisture-wicking functionality.

Figure 5:
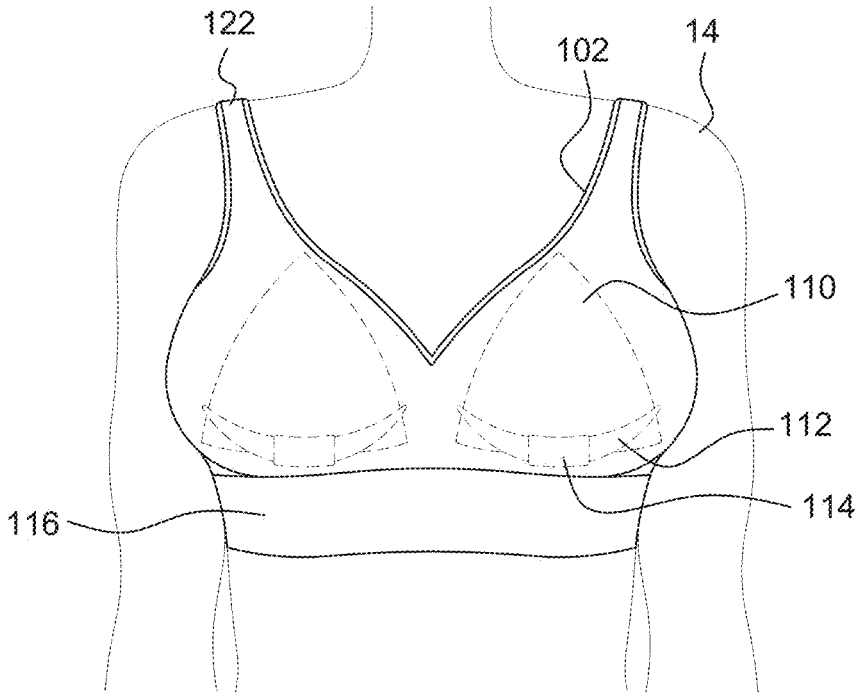
FIG. 5 is a front elevation view of a bra according to another embodiment of the present disclosure, shown in use.
Figure 6:
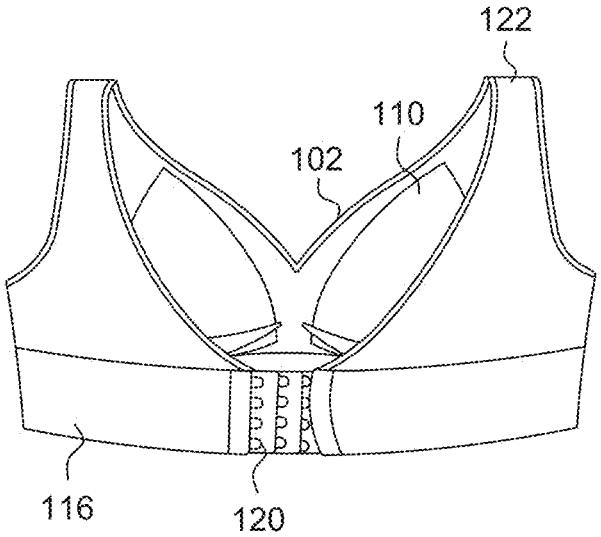
FIG. 6 is a rear elevation view thereof, shown in a closed position.

A bra 102 according to another embodiment of the present invention is depicted in FIG. 5, worn by a user 14. Absorbent inserts 112 are securely retained in sleeves 114 positioned beneath each bra cup 110, enabling them to be angled or shifted for comfort. The insert 112 is arcuate in shape, resembling a banana or crescent-moon, with tapered ends to ensure a snug and adjustable fit beneath the breast and effective perspiration capture. This configuration enables the insert 112 to pivot or shift within the sleeve 114, ensuring optimal positioning for different body shapes and user preferences. The sleeve 114 also facilitates the removability of the insert 112, allowing for easy washing or replacement as needed. The shoulder straps 122 extend from the upper edges of the bra cups 110 to the back of the bra 102 and a wide elastic band 116 encircles the user's torso. The elastic band 116 is approximately three inches wide and covered with fabric to prevent rolling and enhance comfort. This band provides sturdy support for the bra 102, ensuring that the bra stays securely in place during use. The combination of the elastic band 116 and the absorbent insert 112 contributes to the overall functionality and comfort provided by the bra 102. The bra 102 incorporates a hook-and-loop closure 120, as seen in FIG. 6, positioned at the rear of the bra 102 on the elastic band 116 for an adjustable fit, while straps 122 distribute weight for enhanced comfort.

Figure 7:
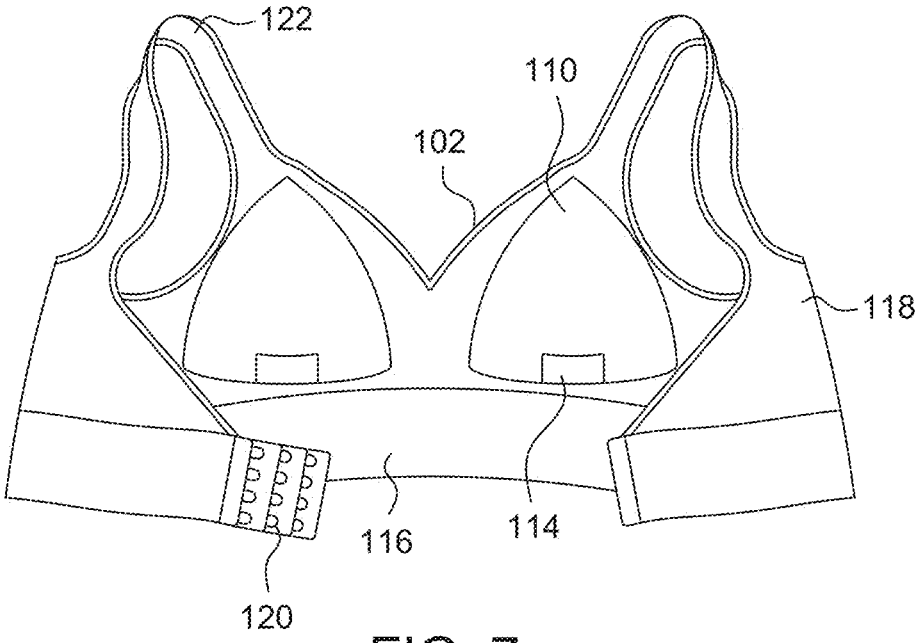
FIG. 7 is another rear elevation view thereof, shown in an opened position with the inserts removed for clarity.
Figure 8:
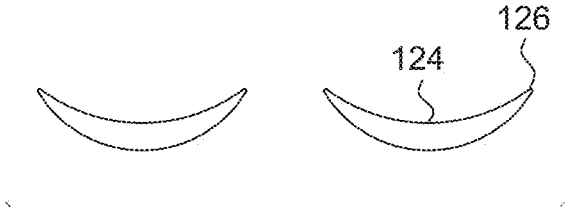
FIG. 8 is a detail view of inserts of the bra of FIG. 5.

FIG. 7 highlights the sleeve 114, located along the lower interior region of each bra cup 110, configured to house the absorbent insert (see FIG. 8). This sleeve allows for the secure placement of the insert while enabling adjustability to accommodate different body shapes and user preferences. The sleeve 114 facilitates the removability of the insert, ensuring ease of maintenance and replacement. Side panels 118 contribute to the overall structure of the bra.

Detailed in FIG. 8, the insert 112 includes a wide arcuate midpoint 124 and tapered ends 126, maximizing moisture absorption and ergonomic fit. The wide arcuate midpoint 124 is designed to offer an expanded surface area for moisture absorption and contact with the skin. This central region plays a significant role in capturing perspiration effectively, as it aligns with the area where moisture tends to accumulate most beneath the breast. The curvature of the midpoint 124 also enhances the ergonomic fit of the insert, helping to maintain secure positioning during use. The tapered ends 126 are designed to enhance the adjustability and comfort of the insert 112. The narrowing of the ends allows the insert 112 to conform seamlessly to the varying contours of the user's body, ensuring a snug and discreet fit. The tapered design also facilitates the ability of the insert 112 to pivot or shift slightly within its housing, such as a sleeve or compartment in the bra, to accommodate different body shapes and user preferences. This adjustability is particularly beneficial for maintaining comfort during extended wear or physical activity. This design also supports the dual functionality of the insert, offering a subtle lifting effect in addition to the primary moisture-wicking properties.

Figure 9:
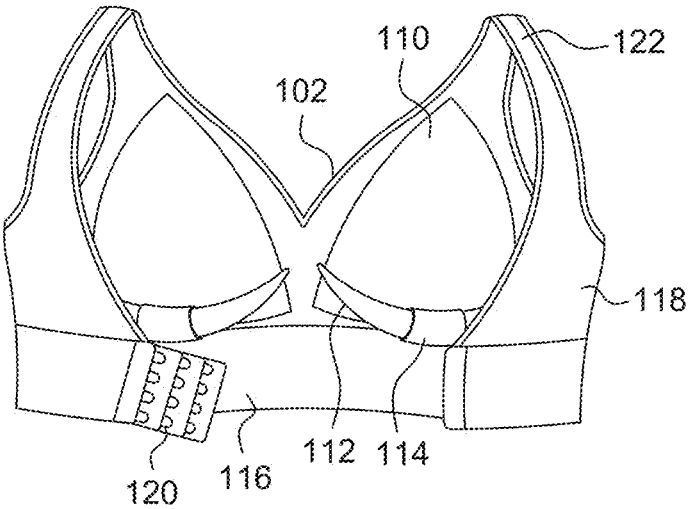
FIG. 9 is another rear elevation view of the bra of FIG. 5.

FIG. 9 combines the cups 110, inserts 112 in sleeves 114, a wide elastic band 116, side panels 118, hook-and-loop closure 120, and adjustable straps 122, delivering targeted perspiration management, support, and comfort in a discreet, user-friendly design.

It should be understood, of course, that the foregoing relates to exemplary embodiments of the invention and that modifications may be made without departing from the spirit and scope of the invention as set forth in the following claims.

What is claimed is:

1. A bra comprising:

a pair of cups configured to support respective breasts of a wearer; and a pair of absorbent inserts mounted to the pair of cups, wherein the pair of absorbent inserts are substantially symmetrical arcuate pads with tapered ends and are configured to conform to a lower curvature of the respective breasts; and wherein the pair of absorbent inserts are operative to absorb perspiration beneath the respective breasts;

wherein each of the pair of absorbent inserts comprises a wide arcuate midpoint region and tapered ends that narrow from the midpoint region, wherein the tapered ends are unattached to the pair of cups and remain free to pivot away from the pair of cups; and wherein each of the pair of absorbent inserts is positionable in an inframammary fold region directly underneath a respective breast.

2. The bra of claim 1, wherein the pair of absorbent inserts comprise an antimicrobial and odor-neutralizing material.

3. The bra of claim 2, wherein the antimicrobial and odor neutralized material comprises about 70% viscose from bamboo and about 30% cotton.

4. The bra of claim 1, wherein the pair of absorbent inserts further comprise a scented composition.

5. The bra of claim 1, further comprising a fabric sleeve integrally formed with an inner lining of a respective one of the pair of cups along a lower interior region of each of the cups, wherein each respective fabric sleeve defines a throughbore that removably accommodates a respective one of the absorbent inserts without an adhesive.

6. The bra of claim 5, wherein the fabric sleeve is configured to allow the pair of absorbent inserts to pivot within each respective fabric sleeve.

7. The bra of claim 5, wherein the pair of absorbent inserts are slidably received within each respective fabric sleeve.

8. The bra of claim 1, wherein the pair of absorbent inserts are each stitched along a lower interior region of a respective one of the pair of cups.

9. The bra of claim 8, wherein the pair of absorbent inserts is each pivotable within a respective one of the pair of cups along a stitched edge.

* * * * *